US009779864B2

(12) United States Patent
Brand

(10) Patent No.: US 9,779,864 B2
(45) Date of Patent: Oct. 3, 2017

(54) MAGNETIC LATCHING IN A CURVE

(71) Applicant: Intel Corporation, Santa Clara, CA (US)

(72) Inventor: Jason Brand, Placerville, CA (US)

(73) Assignee: Intel Corporation, Santa Clara, CA (US)

( * ) Notice: Subject to any disclaimer, the term of this patent is extended or adjusted under 35 U.S.C. 154(b) by 24 days.

(21) Appl. No.: 14/548,909

(22) Filed: Nov. 20, 2014

(65) Prior Publication Data

US 2016/0148730 A1 May 26, 2016

(51) Int. Cl.
*H01F 7/02* (2006.01)

(52) U.S. Cl.
CPC ..... *H01F 7/021* (2013.01)

(58) Field of Classification Search
CPC ..... H01F 7/0263; H01F 7/0252; H01F 7/02; H01F 7/021; H01F 7/0278; H01F 7/0221; H01F 13/003; H01F 41/026; A45C 13/1069
USPC ..... 335/284, 285, 302–306
See application file for complete search history.

(56) References Cited

U.S. PATENT DOCUMENTS

| | | | | |
|---|---|---|---|---|
| 4,486,729 | A * | 12/1984 | Lee | 335/306 |
| 7,423,506 | B2 * | 9/2008 | Terasaki | 335/306 |
| 8,878,637 | B2 * | 11/2014 | Sartee et al. | 335/219 |
| 2007/0205854 | A1 * | 9/2007 | Kazadi | 335/306 |
| 2014/0062629 | A1 * | 3/2014 | Ow et al. | 335/285 |
| 2015/0013113 | A1 * | 1/2015 | Calman et al. | 24/3.1 |
| 2015/0213934 | A1 * | 7/2015 | Michaelis | 335/306 |

* cited by examiner

*Primary Examiner* — Bernard Rojas
(74) *Attorney, Agent, or Firm* — International IP Law Group, P.L.L.C.

(57) ABSTRACT

Techniques related to magnetic latching are described herein. The techniques may include a first magnet formed in a curve, and a second magnet formed in the curve. A pole of the first magnet and a pole of the second magnet are directed inward toward a center line of the curve.

19 Claims, 5 Drawing Sheets

100

100

200

300

400

500

MAGNETIC LATCHING IN A CURVE

TECHNICAL FIELD

This disclosure relates generally to techniques for magnetic latching. Specifically, this disclosure relates to a magnets formed in a curve having unique pole directions.

BACKGROUND ART

Magnets may be used as latching components. For example, a tablet computer may include a magnetic edge to receive a cover at the computing device effectively latching the cover to the tablet computer. In some cases, magnets are placed in a planar orientation. Further, in many cases, additional material is used to control and direct a magnetic force associated with a magnetic latching components such that leaking of magnetic force to an external environment is reduced. For example, a backing plate having some magnetic reluctance may be used to reduce magnetic force in one direction while a front plate may be used to increase magnetic force in an opposite direction. In some cases, the added material for backing or front plates may increase cost and size of magnetic latching systems. Further, in these scenarios, a relatively larger magnet may be required in order to compensate for magnetic attraction at one or more of the plates, rather than in an intended direction.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

The present disclosure relates generally to techniques for implementing a magnetic latching. As discussed above, mechanisms for magnetic latching may face challenges in magnetic leakage as magnetic fields associated with a given magnet may result in an unintended attractive force exerted towards elements within an environment. The techniques described herein include magnets having poles in specific orientations such that the resulting magnetic field is concentrated towards in a specific direction. For example, the techniques described herein may include a first magnet formed in a curve and a second magnet formed in the curve. Poles of each of the first and second magnets are directed toward a center line of the curve. The direction of the magnetic poles of at least two magnets formed in the curve may provide a concentrated magnetic field in the direction of the center line. In some cases, a third magnet disposed between the first and second magnet may be implemented. The pole of the third magnet may be directed towards the center line and the poles of each of the first and second magnet may be nonparallel to the pole of the third magnet, as described in more detail below. The techniques described herein may reduce magnetic leakage and increase a holding force of a peripheral device to magnets in the curve.

Figure 1:
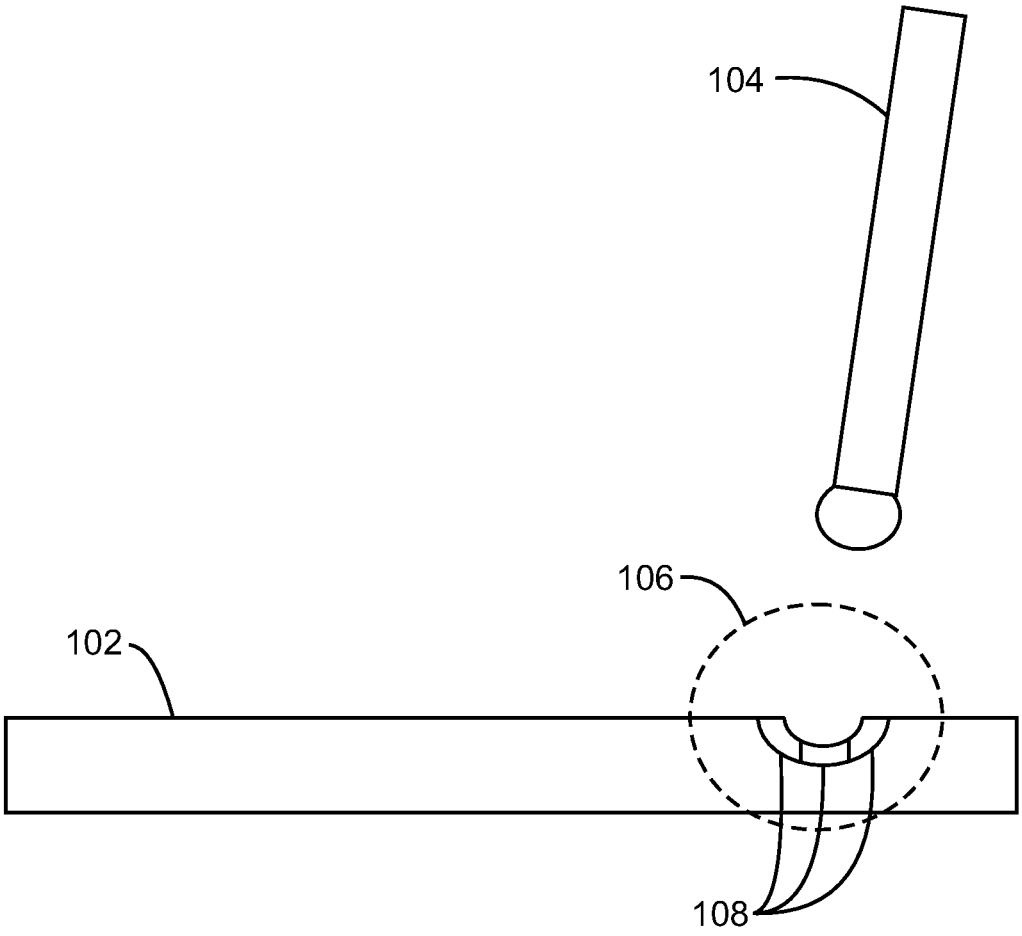
FIG. 1 is a diagram illustrating a side view of a computing device having a surface to receive a peripheral device via a magnetic latch.

FIG. 1 is a diagram illustrating a side view of a computing device having a surface to receive a peripheral device via a magnetic latch. A computing device 102 may be a tablet computing device, a mobile computing device, an all-in-one computing device, or any other device configured to receive a peripheral device 104 at a magnetic latch as indicated at the dashed circle 106.

As illustrated in FIG. 1, the magnetic latch 106 may include a curved recess having magnets 108 formed along the curved recess. As discussed above and in more detail below, a pole direction of the magnets 108 formed in the curve of the recess may be configured to drive a magnetic field in a specific direction. In the example illustrated in FIG. 1, the direction may be towards a center of the curved recess such that a holding force between the magnets 108 and the peripheral device 104.

In some cases, the magnetic latching 108 may be a recess formed on the peripheral device 104 rather than the computing device 102. Further, the magnetic latching 108 need not be formed on a computing device. Instead, the techniques described herein include the magnetic latching 108 formed on any surface to receive another component having a magnetic member into the curve of the magnetic latching 108.

Figure 2:
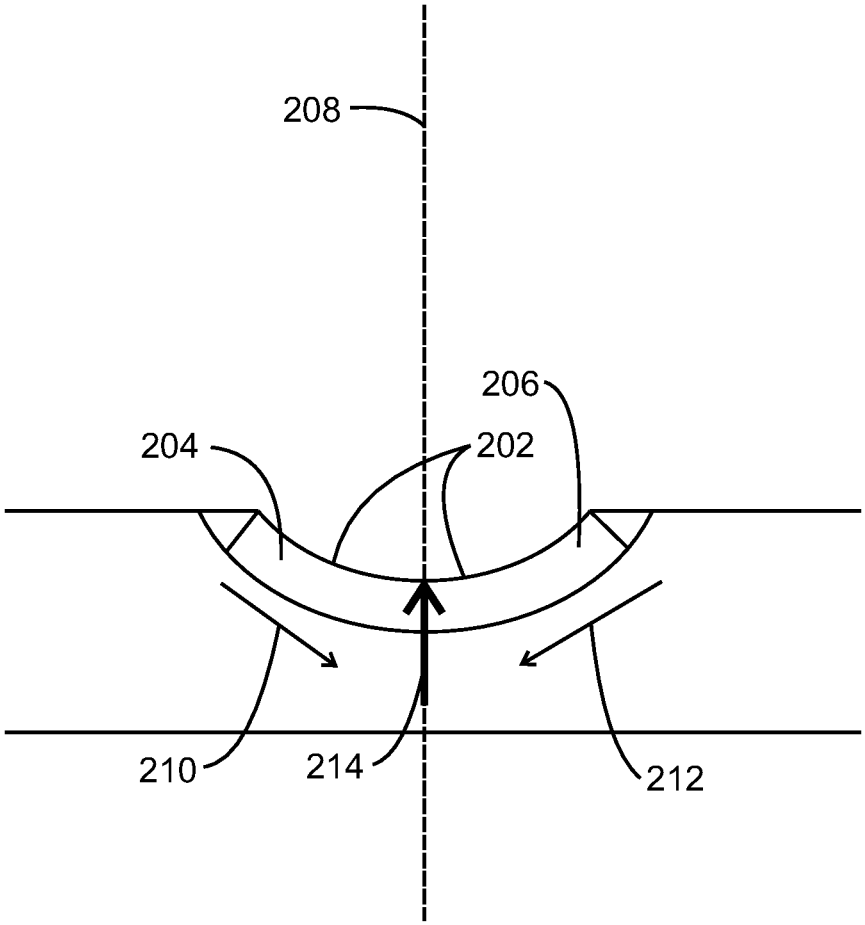
FIG. 2 is a diagram illustrating a recess having magnets formed in a curve of the recess.

FIG. 2 is a diagram illustrating a recess having magnets formed in a curve of the recess. In embodiments, a recess may form a curve as indicated at 202. A first magnet 204 and a second magnet 206 may be disposed along the curve 202. A magnetic pole of the first magnet 204 may be directed towards a center line 208, as indicated by the arrow 210. A magnetic pole of the second magnet 206 may be directed towards the center line 208, as indicated by the arrow 212. The directions of the magnetic poles 210 and 212 may result in a combined force 214 directed along the center line 208.

As discussed in more detail below, the combined force 214 may be a result of pole directions, such as the pole directions 210 and 212. In some cases, the combined force 214 may reduce leakage of magnetic force that may otherwise occur without the pole orientations 210 and 212.

Figure 3:
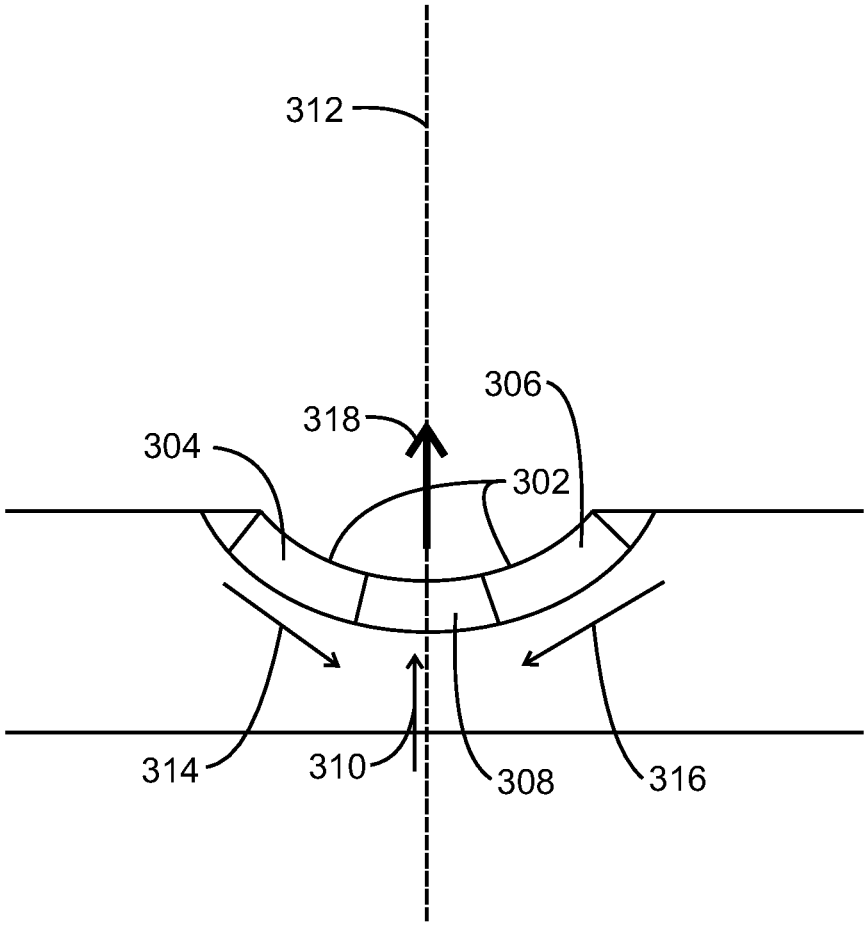
FIG. 3 is a diagram illustrating a recess having three magnets formed in a curve of the recess.

FIG. 3 is a diagram illustrating a recess having three magnets formed in a curve of the recess. Similar to the scenario discussed above in regard to FIG. 2, a recess may form a curve, as indicated at 302. Magnets including a first magnet 304, a second magnet 306, and a third magnet 308 may be formed along the curve 302. In this example, a pole direction 310 of the third magnet 308 may be towards, or along, a center line 312. A pole direction 314 of the first magnet 304 may be nonparallel to the pole direction 310 of the third magnet 308. A pole direction 316 of the second magnet 306 may also be nonparallel to the pole direction 310 of the third magnet 308.

In this scenario, a holding force 318 may be a result of the combination of the magnetic forces associated with the first magnet 304, the second magnet 306, and the third magnet 308, as well as the unique pole directions of each. The holding force 318 may be relatively stronger than would otherwise occur if the pole directions 310, 314, and 316 were not arranged accordingly. In other words, the orientation of the pole directions 310, 314, and 316 may reduce leakage of magnetic fields and instead increase the holding force 318 as a result.

Figure 4:
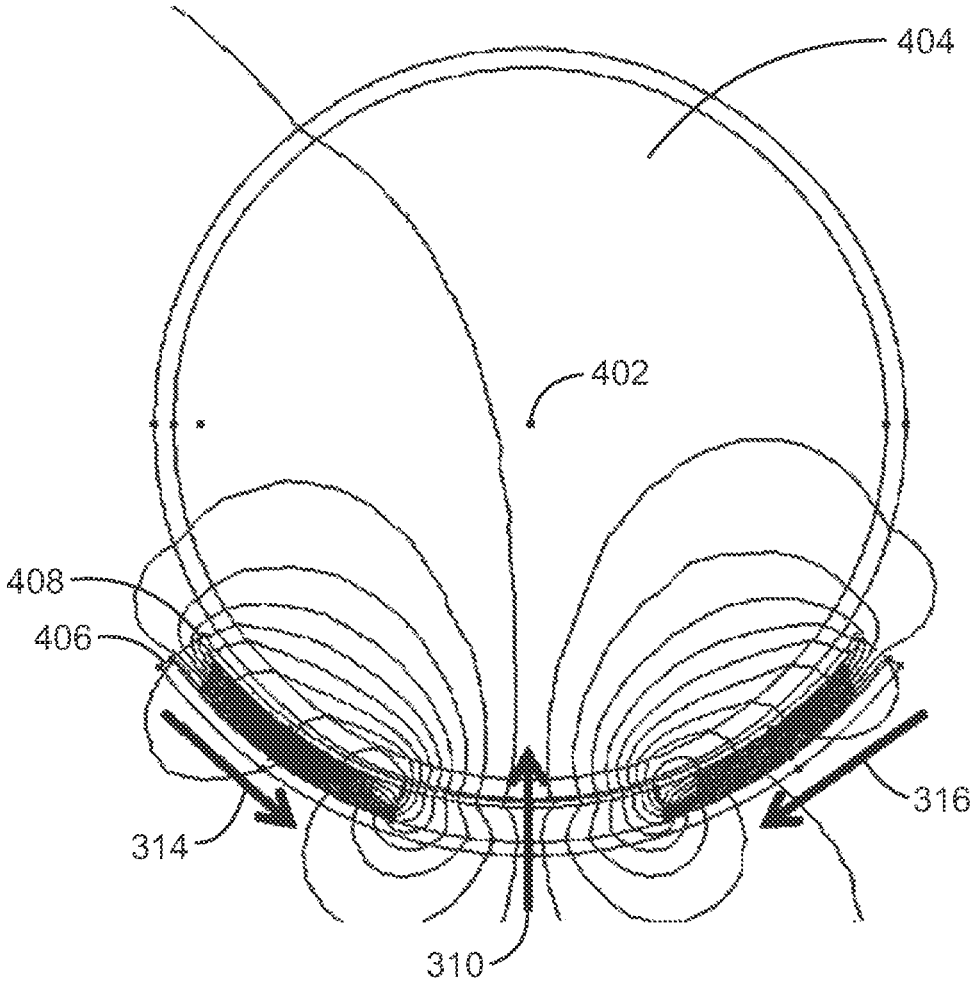
FIG. 4 is a diagram illustrating magnetic field direction resulting from three magnets formed in a curve.

FIG. 4 is a diagram illustrating magnetic field direction resulting from three magnets formed in a curve. As discussed above, magnetic pole directions 314 and 316 of the first magnet 304 and the second magnet 306 may be non-parallel to the magnetic pole direction 310 of the third magnet 308 disposed between the first magnet 304 and the second magnet 308. This orientation effective pumps the combined magnetic field from each of the magnets 304, 306, and 308 towards a center, indicated at 402. The center 402 may be a center of a barrel 404 of a magnetic latch, such as a barrel of the peripheral device 104 discussed above in regard to FIG. 1.

In some cases, a backing plate 406 may be disposed on an outer diameter of the magnets 304, 306, and 308. The backing plate 406 may further reduce magnetic leakage. In some cases, the backing plate 406 is composed of material having a high magnetic resistance. A front plate 408 may be disposed on an inner diameter of the magnets 304, 306, and 308. The front plate may be composed of a material having relatively low magnetic reluctance in comparison to the backing plate 406.

In some cases, the magnets 304 and 306 may be exhibit a righting alignment tendency wherein each of the first and second magnets 304, 306 have a tendency to flip. Therefore, the embodiments described herein may include mounting the first magnet 304 and the second magnet 308 to either the backing plate 406 or a front plate (not shown).

Figure 5:
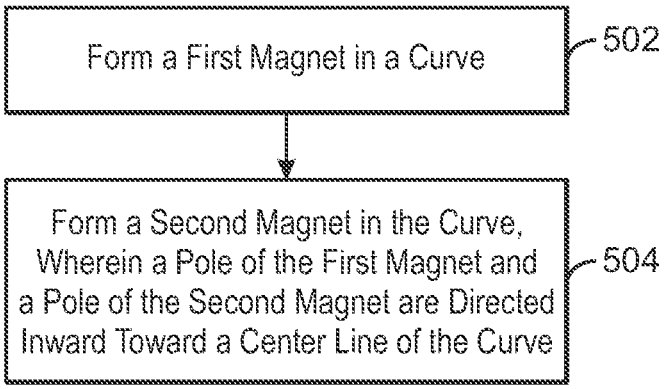
FIG. 5 is a block diagram illustrating a method of forming a magnetic latching.

FIG. 5 is a block diagram illustrating a method of forming a magnetic latching. At block 502, a first magnet is formed in a curve. The first magnet may be formed to be non-linear.

At block 504, a second magnet is formed in the curve. Similar to the first magnet, the second magnet may be formed to be non-linear. A pole of the first and second magnet may be distinct from each other. However, the directions of each pole associated with a respective magnet may be directed towards a center line of the curve.

In some embodiments, the method 500 may include forming a third magnet to be disposed between the first and second magnet. In this scenario, the pole directions of the first and second magnet may be nonparallel to the pole direction of the third magnet. The unique pole directions of the magnets in combination may produce an increased magnetic holding force. The increased holding force may therefore reduce magnetic leakage that may otherwise occur.

In some cases, the method may include forming a backing plate to be disposed at the outer diameter of the magnets in the curve. The backing plate may be selected of a specific reluctance to further reduce magnetic leakage in a direction opposite to the curve. In some cases, the curve is a recess formed in a surface of a device. Further, in some cases an inner plate may be formed. The inner plate may be of a magnetic reluctance selected to increase magnetic latching o the magnets to a given component to be received at the curved recess. The arrangement and direction of the magnetic poles may also enable thinner magnets to be used. Thinner magnets may be useful in slimmer form factor designs, and may reduce overall production costs.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Example 1 includes an apparatus for magnetic latching. The apparatus includes a first magnet formed in a curve and second magnet formed in a curve. The first and the second magnet each have their respective poles. The pole of the first magnet and the second magnet are directed inward toward a center line of the curve.

Example 2 incorporates the subject matter of Example 1. In this example, the apparatus further includes a third magnet disposed between the first magnet and the second magnet.

Example 3 incorporates the subject matter of any combination of Examples 1-2. In this example, the poles of the first and second magnet are nonparallel to the pole of the third magnet.

Example 4 incorporates the subject matter of any combination of Examples 1-3. In this example, the pole directions of the first, second, and third magnets are distinct from each other.

Example 5 incorporates the subject matter of any combination of Examples 1-4. In this example, the curve is a concave curve of a device surface.

Example 6 incorporates the subject matter of any combination of Examples 1-5. In this example, the apparatus further includes a backing plate disposed on an outer diameter of the magnets, wherein the magnets are disposed between the backing plate and the curve of the device surface.

Example 7 incorporates the subject matter of any combination of Examples 1-6. In this example, the apparatus further includes an inner plate disposed between the magnets and the curve of the device surface.

Example 8 incorporates the subject matter of any combination of Examples 1-7. In this example, the magnets are affixed to the inner plate.

Example 9 incorporates the subject matter of any combination of Examples 1-8. In this example, the formation of the magnets in the curve is to focus a magnetic field associated with a combination of the magnets and their respective pole directions.

Example 10 incorporates the subject matter of any combination of Examples 1-9. In this example, the focusing of the magnetic field is to increase a holding force of the magnets to a peripheral component to be received at the curve.

Example 11 includes a method of forming a magnetic latching. The method includes forming a first magnet in a curve. The method also includes forming a second magnet in a curve. A pole of the first magnet and a pole of the second magnet are formed to be directed inwards toward a centerline of the curve.

Example 12 incorporates the subject matter of Example 11. In this example, the method further includes forming a third magnet disposed between the first magnet and the second magnet.

Example 13 incorporates the subject matter of any combination of Examples 11-12. In this example, the poles of the first and second magnet are nonparallel to the pole of the third magnet.

Example 14 incorporates the subject matter of any combination of Examples 11-13. In this example, the pole directions of the first, second, and third magnets are distinct from each other.

Example 15 incorporates the subject matter of any combination of Examples 11-14. In this example, the curve is a concave curve of a device surface.

Example 16 incorporates the subject matter of any combination of Examples 11-15. In this example, the magnets are disposed between the backing plate and the curve of the device surface.

Example 17 incorporates the subject matter of any combination of Examples 11-16. In this example, the method further includes forming an inner plate disposed between the magnets and the curve of the device surface.

Example 18 incorporates the subject matter of any combination of Examples 11-17. In this example, the method further includes affixing the magnets to the inner plate.

Example 19 incorporates the subject matter of any combination of Examples 11-18. In this example, the formation of the magnets in the curve is to focus a magnetic field associated with a combination of the magnets and their respective pole directions.

Example 20 incorporates the subject matter of any combination of Examples 11-19. In this example, the focus of the magnetic field is to increase a holding force of the magnets to a peripheral component to be received at the curve.

Example 21 includes a system for magnetic latching. The system includes a device housing including a curved recess. The system also includes a first magnet disposed on the curved recess and a second magnet formed on the curved recess. A pole of the first magnetic means and a pole of the second magnetic means are directed inward toward a center line of the curve.

Example 22 incorporates the subject matter of Example 21. In this example, the system further includes a third magnet disposed between the first magnet and the second magnet.

Example 23 incorporates the subject matter of any combination of Examples 21-22. In this example, the poles of the first and second magnet are nonparallel to the pole of the third magnet.

Example 24 incorporates the subject matter of any combination of Examples 21-23. In this example, the pole directions of the first, second, and third magnets are distinct from each other.

Example 25 incorporates the subject matter of any combination of Examples 21-24. In this example, the curved recess is a concave curve of a surface of the device housing.

Example 26 incorporates the subject matter of any combination of Examples 21-25. In this example, the magnets are disposed between the backing plate and the curve of the surface.

Example 27 incorporates the subject matter of any combination of Examples 21-26. In this example, the system further includes an inner plate disposed between the magnets and the curve of the surface.

Example 28 incorporates the subject matter of any combination of Examples 21-27. In this example, the magnets are affixed to the inner plate.

Example 29 incorporates the subject matter of any combination of Examples 21-28. In this example, the formation of the magnets in the curve is to focus a magnetic field associated with a combination of the magnets and their respective pole directions.

Example 31 includes an apparatus for magnetic latching. The apparatus includes a first magnetic means formed in a curve and second magnetic means formed in a curve. The first and the second magnetic means each have their respective poles. The pole of the first magnetic means and the second magnetic means are directed inward toward a center line of the curve.

Example 32 incorporates the subject matter of Example 1. In this example, the apparatus further includes a third magnetic means disposed between the first magnetic means and the second magnetic means.

Example 33 incorporates the subject matter of any combination of Examples 31-32. In this example, the poles of the first and second magnetic means are nonparallel to the pole of the third magnetic means.

Example 34 incorporates the subject matter of any combination of Examples 31-33. In this example, the pole directions of the first, second, and third magnetic means are distinct from each other.

Example 35 incorporates the subject matter of any combination of Examples 31-34. In this example, the curve is a concave curve of a device surface.

Example 36 incorporates the subject matter of any combination of Examples 31-35. In this example, the apparatus further includes a backing plate disposed on an outer diameter of the magnetic means, wherein the magnetic means are disposed between the backing plate and the curve of the device surface.

Example 37 incorporates the subject matter of any combination of Examples 31-36. In this example, the apparatus further includes an inner plate disposed between the magnetic means and the curve of the device surface.

Example 38 incorporates the subject matter of any combination of Examples 31-37. In this example, the magnetic means are affixed to the inner plate.

Example 39 incorporates the subject matter of any combination of Examples 31-38. In this example, the formation of the magnetic means in the curve is to focus a magnetic field associated with a combination of the magnetic means and their respective pole directions.

Example 40 incorporates the subject matter of any combination of Examples 31-39. In this example, the focusing of the magnetic field is to increase a holding force of the magnetic means to a peripheral component to be received at the curve.

Example 41 includes a magnetic latching mechanism of a device housing. The magnetic latching mechanism of the device housing includes a first magnet formed in a curve and second magnet formed in a curve. The first and the second magnet each have their respective poles. The pole of the first magnet and the second magnet are directed inward toward a center line of the curve.

Example 42 incorporates the subject matter of Example 41. In this example, the magnetic latching mechanism of the device housing further includes a third magnet disposed between the first magnet and the second magnet.

Example 43 incorporates the subject matter of any combination of Examples 41-42. In this example, the poles of the first and second magnet are nonparallel to the pole of the third magnet.

Example 44 incorporates the subject matter of any combination of Examples 41-43. In this example, the pole directions of the first, second, and third magnets are distinct from each other.

Example 45 incorporates the subject matter of any combination of Examples 41-44. In this example, the curve is a concave curve of a device surface.

Example 46 incorporates the subject matter of any combination of Examples 41-45. In this example, the magnetic latching mechanism of the device housing further includes a backing plate disposed on an outer diameter of the magnets, wherein the magnets are disposed between the backing plate and the curve of the device surface.

Example 47 incorporates the subject matter of any combination of Examples 41-46. In this example, the magnetic latching mechanism of the device housing further includes an inner plate disposed between the magnets and the curve of the device surface.

Example 48 incorporates the subject matter of any combination of Examples 41-47. In this example, the magnets are affixed to the inner plate.

Example 49 incorporates the subject matter of any combination of Examples 41-48. In this example, the formation of the magnets in the curve is to focus a magnetic field associated with a combination of the magnets and their respective pole directions.

Example 50 incorporates the subject matter of any combination of Examples 41-49. In this example, the focusing of the magnetic field is to increase a holding force of the magnets to a peripheral component to be received at the curve.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus for magnetic latching, comprising:

a first magnet formed in a curve, wherein the curve is a concave curve of a device surface;

a second magnet formed in the curve, wherein a pole of the first magnet and a pole of the second magnet are directed inward toward a center line of the curve to increase a holding force applied by the first magnet and the second magnet; and a front plate disposed between the magnets and the curve of the device surface;

wherein the concave curve of the device surface is to receive a cylindrical magnetic member of a peripheral device and the first magnet and the second magnet apply a holding force to the cylindrical magnetic member for coupling the peripheral device to the device.

2. The apparatus of claim 1, further comprising a third magnet disposed between the first magnet and the second magnet.

3. The apparatus of claim 2, wherein the poles of the first and second magnet are nonparallel to the pole of the third magnet.

4. The apparatus of claim 2, wherein the pole directions of the first, second, and third magnets are distinct from each other.

5. The apparatus of claim 1, further comprising a backing plate disposed on an outer diameter of the magnets, wherein the magnets are disposed between the backing plate and the curve of the device surface.

6. The apparatus of claim 1, wherein the magnets are affixed to the front plate.

7. The apparatus of claim 1, wherein the formation of the magnets in the curve is to focus a magnetic field associated with a combination of the magnets and their respective pole directions.

8. The apparatus of claim 1, wherein the focusing of the magnetic field is to increase a holding force of the magnets to a peripheral component to be received at the curve.

9. A method of forming a magnetic latching, comprising:

forming a first magnet in a curve, wherein the curve is a concave curve of a device surface;

forming a second magnet in the curve, wherein a pole of the first magnet and a pole of the second magnet are directed inward toward a center line of the curve to increase a holding force applied by the first magnet and the second magnet; and forming an front plate disposed between the magnets and the curve of the device surface;

wherein the concave curve of the device surface is to receive a cylindrical magnetic member of a peripheral device and the first magnet and the second magnet apply a holding force to the cylindrical magnetic member for coupling the peripheral device to the device.

10. The method of claim 9, further comprising forming a third magnet disposed between the first magnet and the second magnet.

11. The method of claim 10, wherein the poles of the first and second magnet are nonparallel to the pole of the third magnet.

12. The method of claim 10, wherein the pole directions of the first, second, and third magnets are distinct from each other.

13. The method of claim 9, further comprising forming a backing plate at outer diameter of the magnets, wherein the magnets are disposed between the backing plate and the curve of the device surface.

14. The method of claim 9, further comprising affixing the magnets to the inner plate.

15. The method of claim 9, wherein the formation of the magnets in the curve is to focus a magnetic field associated with a combination of the magnets and their respective pole directions.

16. The method of claim 9, wherein the focus of the magnetic field is to increase a holding force of the magnets to a peripheral component to be received at the curve.

17. A system for magnetic latching, comprising:

a device housing comprising a curved recess, wherein the curved recess is a concave curve of the device housing;

a first magnet disposed on the curved recess;

a second magnet disposed on the curved recess;

a third magnet disposed on the curved recess and between the first magnet and the second magnet, wherein poles of the first magnet the second magnet and the third magnet are directed toward a centerline of the curved recess to increase a holding force applied by the first magnet the second magnet and the third magnet, and wherein poles of the first and second magnet are nonparallel to the pole of the third magnet; and a front plate disposed between the magnets and the curve of the concave device housing;

wherein the curved recess of the device housing is to receive a cylindrical magnetic member of a peripheral device, and the first magnet the second magnet and the third magnet apply a holding force to the cylindrical magnetic member for coupling the peripheral device to the device.

18. The system of claim 17, further comprising a backing plate disposed on an outer diameter of the magnets, wherein the magnets are disposed between the backing plate and the concave curve of the device housing.

19. The system of claim 17, wherein the magnets are affixed to the front plate.

* * * * *